United States Patent [19]

Pham

[11] Patent Number: 4,639,565

[45] Date of Patent: Jan. 27, 1987

[54] HIGH TENSION ARC-BLAST CIRCUIT BREAKER

[75] Inventor: Van Doan Pham, Meyzieu, France

[73] Assignee: Alsthom-Atlantique, Paris, France

[21] Appl. No.: 736,505

[22] Filed: May 21, 1985

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,514,605 4/1985 Pham ..... 200/148 R

FOREIGN PATENT DOCUMENTS 54-42979 3/1979 Japan ..... 200/148 A

*Primary Examiner*—Robert S. Macon

*Attorney, Agent, or Firm*—Sughrue, Mion, Zinn, Macpeak & Seas

[57] ABSTRACT

A high tension arc-blast circuit breaker comprising at least one circuit breaker for breaking one phase of a polyphase current and disposed inside an insulating or metal envelope (70), said circuit-breaking device comprising a fixed first assembly having fixed main contacts (21) and fixed anti-sparking contacts (24, 22B ), and a moving second assembly having moving main contacts (31) and moving anti-sparking contacts (34B), the fixed assembly including a first volume (27) in which pressure is increased under the effect of the breaking arc, the gas in said volume expanding via a first nozzle (26A) to blast the arc at a zero crossing in the current to be broken, the second moving assembly including a second volume (37) in which the gas is compressed by a piston at the beginning of the circuit breaker opening phase and is directed onto the arc via a second nozzle (42A) during the later phases, characterized in that the nozzle (26A, 42A) are disposed in such a manner as to prevent any direct passage of blast gases into the volume (71) lying between said assemblies and said envelope.

4 Claims, 5 Drawing Figures

HIGH TENSION ARC-BLAST CIRCUIT BREAKER

The present invention relates to a high tension circuit breaker.

Figure 1:
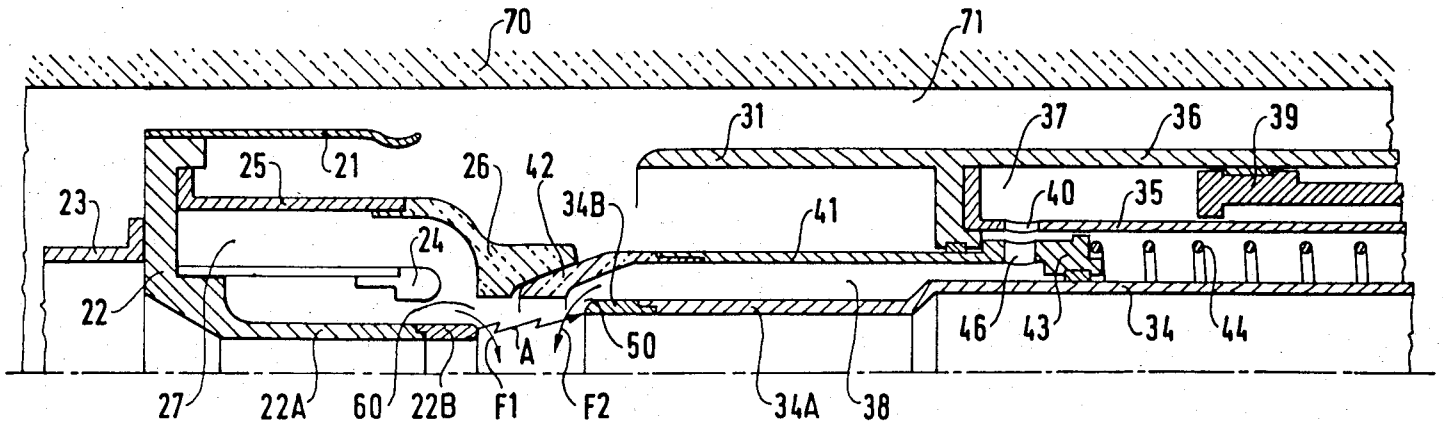

French patent application No. 84 00474 Jan. 13, 1984 describes a circuit breaker which is shown in partial axial section in FIG. 1 of the accompanying drawings. This prior high tension circuit breaker is of the $SF_6$ pneumatic puffer type and includes a first volume 27 in which pressure is increased due to heating from a circuit-breaking arc, with the gas in this volume expanding to extinguish the arc at the next zero crossing of the arc current, and a second volume 37 in which gas is compressed by a piston 39 at the beginning of the circuit breaker opening phase, with the compressed gas being directed on the arc during subsequent phases. The circuit breaker includes main fixed contacts 21, anti-sparking fixed contacts 24 and 22B, a main moving contact 31, and an anti-sparking moving contact 34B, with the arc being extinguished between said anti-spark contacts when the circuit breaker opens.

The first volume 27 and the second volume 37 are disposed on either side of the arc zone.

In the embodiment described in the above-mentioned application, and shown in FIG. 1 of the present application, the first volume 27 is delimited by a tube 22A, 22B which is coaxial with the anti-sparking fixed contacts 24 and an insulating nozzle 26, while the second volume 37 is delimited by a first tube 36 which constitutes the main moving contact and a second tube 35 which is coaxial therewith, one end of said volume being closed by a fixed system 39. The nozzle 26 is mounted on a tube 25.

In addition, a third tube 34, 34A and 34B which is coaxial with the first and second tubes 35 and 36 and which constitutes the anti-sparking moving contact delimits, together with the second tube 35, an annular volume 38 in which a fourth tube 41 terminated by a second insulating nozzle 42 is capable of moving under the action of a piston 43 thrust by one end of a spring 44 whose other end abuts against means fixed to the moving contacts, the third and fourth tubes defining a passage for the gas from the second volume, said gas passing via orifices 40 and 46 in the second and fourth tubes.

Arrows F1 and F2 show the directions of the gas jets during an arc-extinguishing blast. Reference 60 designates the opening delimited by the nozzle 26 and the contact 22A, 22B.

When the circuit breaker reaches the last opening phase, the nozzles 26 and 42 move apart, thereby creating an annular opening through which a portion of the hot gases escape into the volume 71.

The volume 71 is delimited by the main contacts 21 and 36 and by the porcelain 70 which constitutes the envelope of the circuit breaker.

When a three-phase circuit breaker is made with three breaking chambers disposed within a common envelope, it is undesirable for a portion of the hot gases to escape from one chamber to another.

One aim of the present invention is to provide a circuit breaker of the above-mentioned type in which the hot gases can only escape via volumes inside the contacts.

Another aim of the present invention is to provide a circuit breaker of simplified construction.

The present invention provides a high tension arc-blast circuit breaker comprising at least one circuit breaker for breaking one phase of a polyphase current and disposed inside an insulating or metal envelope, said circuit-breaking device comprising a fixed first assembly having fixed main contacts and fixed anti-sparking contacts, and a moving second assembly having moving main contacts and moving anti-sparking contacts, the fixed assembly including a first volume in which pressure is increased under the effect of the breaking arc, the gas in said volume expanding via a first nozzle to blast the arc at a zero crossing in the current to be broken, the second moving assembly including a second volume in which the gas is compressed by a piston at the beginning of the circuit breaker opening phase and is directed onto the arc via a second nozzle during the later phases, characterized in that the nozzles are disposed in such a manner as to prevent any direct passage of blast gases into the volume lying between said assemblies and said envelope.

In a particular embodiment, the said nozzles have interpenetrating portions which move relative to one another during the opening phase up to the end of the circuit-breaking period, and which remain apart when the circuit breaker is in the open position.

For example, the said interpenetrating portions are a tubular groove on one of the nozzles and a tube extending the second, other nozzle.

Figure 2A:
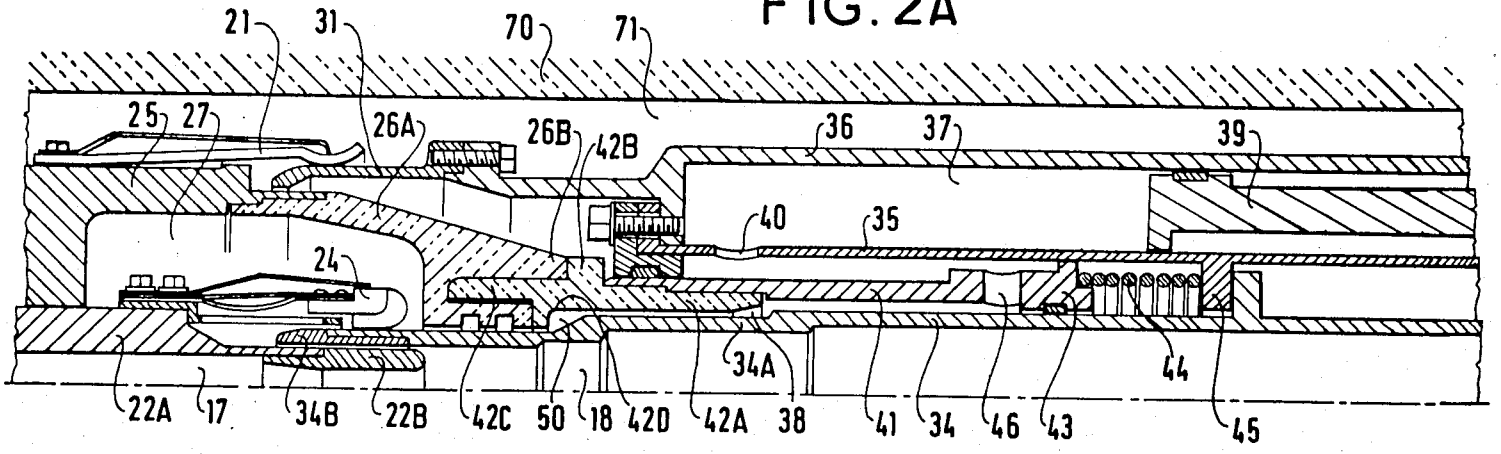
Figure 2B:
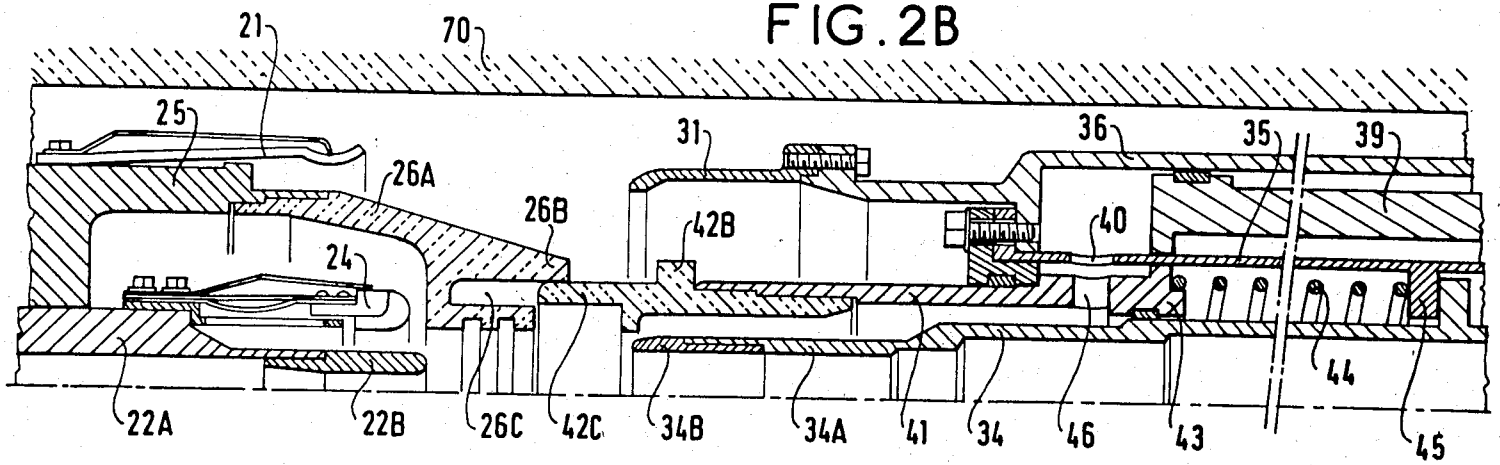
Figure 3A:
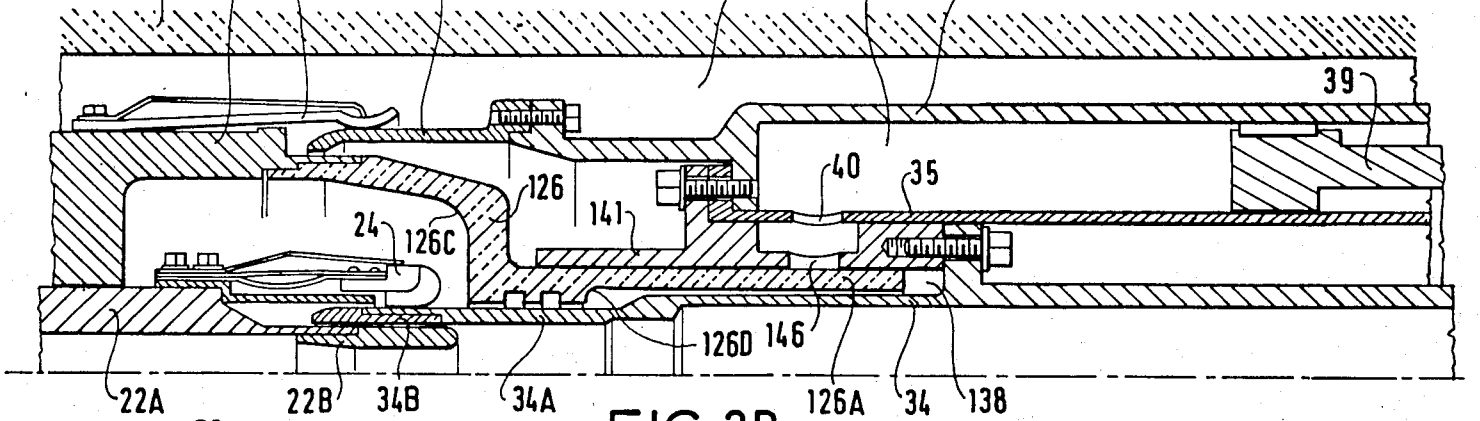
Figure 3B:
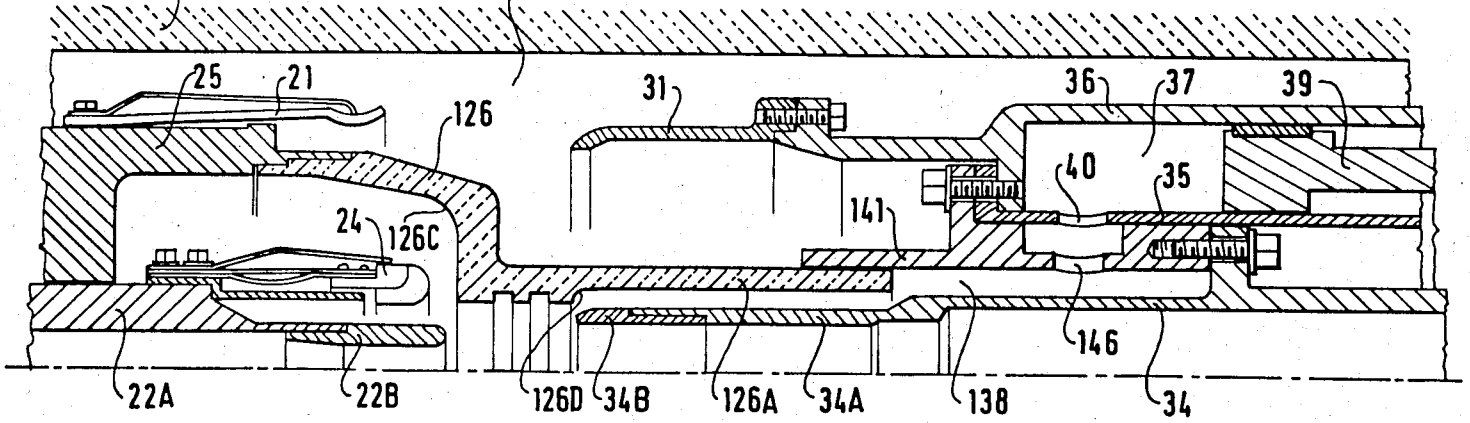

The invention will be well understood from the following description of two embodiments of the invention given with reference to the accompanying drawings, in which:

FIG. 1 is an axial section through a portion of a prior art circuit breaker;

FIGS. 2A and 2B are axial sections through a portion of a first embodiment of a circuit breaker in accordance with the invention shown respectively in the closed position and in an intermediate position at the end of the arc extinction period; and FIGS. 3A and 3B are axial sections through a portion of a second embodiment of a circuit breaker in accordance with the invention respectively shown in the closed position and in the open position.

FIG. 1 has already been described.

FIGS. 2A and 2B are axial sections through a portion of a first embodiment of a circuit breaker in accordance with the invention, and items which are common to FIGS. 1, 2A and 2B have the same reference numerals in all three of said figures.

The figures show one-half of a breaking chamber within the envelope 70 (which may be insulating or made of metal). It is recalled that the envelope contains three identical chambers disposed on the sides of an equilateral triangle centered on the axis of the envelope 70.

As in the prior art embodiment shown in FIG. 1, FIGS. 2A and 2B show a fixed assembly comprising fixed main contacts 21, fixed anti-sparking contacts 24, and the tube 22A which is terminated by a portion 22B of material which withstands the effects of electric arcing.

As in FIG. 1, the tube 22A delimits, together with a tube 25 bearing a nozzle 26A, a volume 27 which acts as a thermal volume.

As in FIG. 1, the moving equipment includes the main moving contact 31 carried by a tube 36 and a second tube 35 having orifices 40 and delimiting, together with a fixed piston 39 a compression volume 37.

The moving equipment further includes a third tube 34 terminated by a portion 34A which bears moving anti-sparking contacts 34B.

A fourth tube 41 (which may be capable of a small degree of movement relative to the moving system by virtue of a piston 43 sliding in the annular space delimited by the tubes 34 and 35 and pressed against a spring 44) bears an insulating nozzle 42A which co-operates with the nozzle 26A in a manner described below.

The tube 41 has orifices 46 which, during the circuit breaking period, move opposite the orifices 40 (FIG. 2B) in order to enable the compressed gas in the volume 37 to escape via the volume 38 and the orifice 50.

Reference 45 designates an abutment fixed to the tube 35 and against which the spring 44 is applied.

Finally, reference 71 designates the volume lying between the circuit breaking assembly and the envelope 70, while references 17 and 18 respectively designates volumes delimited by the inside of tubes 22A and 22B, or by the inside of tubes 34, 34A and 34B.

In this embodiment of the invention, the nozzle 26A is fitted with an annular groove 26C in which a tubular terminal portion 42C of the nozzle 42A is received.

In the closed position, an abutment 42B on the nozzle 42A abuts against a portion 26B of the nozzle 26A. The tubular portion 42C of the semi-moving nozzle is entirely engaged in the groove in the nozzle 26A.

There is no direct communication in the zone around the circuit breaker contacts between the volume 71 and the inside volumes.

While the circuit breaker is being opened, the main contacts move apart and an arc extends between the anti-sparking contacts 24A–22B and 34B. During the movement, the gas in the volume 37 is compressed while the gas in the volume 27 is heated.

During one part of the stroke of the moving equipment, the nozzle 42A remains pressed against the nozzle 26A by virtue of the spring 44 which expands progressively. At the end of the spring stroke, the end of the moving contact 34B reaches the level of the bent portion 42D of the nozzle 42A and defines therewith an annular orifice 50 enabling the compressed gas in the volume 37 to blast the arc.

During the last movement phase of the moving equipment, the nozzle 42 is in turn moved with the part 42C sliding in the groove 26C.

The depth of the groove 26C and of the tubular end 42C of the semi-moving nozzle are selected in such a manner that at the end of the breaking period (FIG. 2B) the end 42C still remains engaged in the groove. In this manner no direct communication exists between the contact zone and the volume 71. The blast gas from the volumes 27 and 37 is evacuated via the inside volumes 17 and 18.

In this manner, the sending of hot gases into the space between the phases of a three-phase circuit breaker having three breaking chambers in the same envelope is avoided. At the end of the opening stroke, the tubular end 42C leaves the groove 26C in order to ensure improved dielectric behavior between the contacts.

FIGS. 3A and 3B show a second embodiment of a circuit breaker in accordance with the invention in the closed position and the open position respectively. Items common to FIGS. 1, 3A and 3B have the same reference numerals.

As before, the moving equipment includes:

fixed main contacts;

the tube 25 bearing the nozzle which is now referenced 126;

the tube 22A, 22B which together with the tube 25 delimits the thermal volume 27; and the anti-sparking contacts 24.

The moving portion is a little different from the moving portions of FIGS. 1, and 2A and 2B.

It comprises a tube 36 whose end bears the moving main contacts 31, a tube 35 which together with a piston 39 delimits a compression volume 37, and a tube 34A terminated by anti-sparking contacts 34B.

The previous semi-moving portion is omitted and replaced by a tubular portion 141 which is fixed to the portions 36, 35 and 34 and together with the tube 34 delimits an annular volume 138.

Orifices 40 in the tube 35 and 146 in the tube 141 situated opposite one another put the volumes 37 and 138 into communication with each other.

The nozzle 126 is extended by a tubular portion 126A which engages insde the tubular portion 141.

The length of the portion 126A is such that in the closed position of the circuit breaker (FIG. 3A) it closes the orifices 146, and in the open position at the end of the breaking period (FIG. 3B) it still remains in contact with the portion 141 in such a manner as to prevent any direct passage of the blast gas into the space 71.

Operation is analogous to that described above.

It may be observed that the nozzle 126–126A has a first concave portion 126C for radially directing the gases from the volume 27 and a second concave portion 126D likewise for radially directing the gases from the compression volume.

I claim:

1. In a high tension arc-blast circuit breaker comprising at least one circuit breaker for breaking one phase of a polyphase current and disposed inside an insulating or metal envelope (70), said circuit-breaking device comprising a fixed first assembly having fixed main contacts (21) and fixed anti-sparking contacts (24, 22B), and a moving second assembly having moving main contacts (31) and moving anti-sparking contacts (34B), the fixed assembly including a first volume (27) in which pressure is increased under the effect of the breaking arc, the gas in said volume expanding via a first nozzle (26A) to blast the arc at a zero crossing in the current to be broken, the second moving assembly including a second volume (37) in which the gas is compressed by a piston at the beginning of the circuit breaker opening phase and is directed onto the arc via a second nozzle (42A) during the later phases, the improvement comprising interengaging means carried by said nozzles (26A, 42A) which remain in contact over the full extent of relative movement between said nozzles to prevent any direct passage of blast gases into the volume (71) lying between said assemblies and said envelope.

2. A circuit breaker according to claim 1, characterized in that the said nozzles (26A, 42A) include interpenetrating portions (26C, 42C) which move relative to each other during the opening phase up to the end of the circuit breaking period, and which remain in contact in the open position of the circuit breaker.

3. A circuit breaker according to claim 2, characterized in that the said interpenetrating portions comprise an annular groove (26C) formed within one of the nozzles, and a tube (42C) extending the second, other nozzle and projecting within said groove.

4. A circuit breaker according to claim 1, characterized in that one of the nozzles (126) is extended by means of a tubular portion (126A) which peripherally engages a tube (141) borne by the assembly to which the other nozzle belongs.

* * * * *